United States Patent [19]

Hattori et al.

[11] 4,175,990

[45] Nov. 27, 1979

[54] WATER-GEL EXPLOSIVE AND A METHOD OF PRODUCING THE SAME

[75] Inventors: Katsuhide Hattori; Masao Takahashi, both of Aichi, Japan

[73] Assignee: Nippon Oil and Fats Co., Ltd., Tokyo, Japan

[21] Appl. No.: 916,724

[22] Filed: Jun. 19, 1978

[30] Foreign Application Priority Data

Jun. 27, 1977 [JP] Japan ..... 52/75485

[51] Int. Cl.[2] ..... C06B 45/02

[52] U.S. Cl. ..... 149/21; 149/62; 149/70; 149/85; 149/89

[58] Field of Search ..... 149/27, 47, 70, 62, 149/85, 89

[56] References Cited

U.S. PATENT DOCUMENTS

| | | | |
|---|---|---|---|
| 3,695,947 | 10/1972 | Edwards | 149/89 X |
| 3,762,970 | 10/1973 | Ballard et al. | 149/89 X |
| 3,765,966 | 10/1973 | Edwards | 149/89 X |
| 3,966,516 | 6/1976 | Sakai et al. | 149/89 X |

*Primary Examiner*—Stephen J. Lechert, Jr.

*Attorney, Agent, or Firm*—Stevens, Davis, Miller & Mosher

[57] ABSTRACT

A water-gel explosive comprising ammonium nitrate alone or in admixture with other inorganic oxidized acid salt, water, nitroparaffin having 1 to 3 carbon atoms, a gelatinizing agent for water, a gelatinizing agent for nitroparaffin, glass hollow microspheres and an amide has a high initiation sensitivity even at low temperature.

21 Claims, 2 Drawing Figures

WATER-GEL EXPLOSIVE AND A METHOD OF PRODUCING THE SAME

BACKGROUND OF THE INVENTION (1) Field of the Invention

The present invention relates to a water-gel explosive comprising ammonium nitrate alone or in admixture with other inorganic oxidized acid salt, water, nitroparaffin having 1 to 3 carbon atoms, gelatinizing agents for water and nitroparaffin, glass hollow microspheres and an amide, which can be initiated by the No. 6 detonator in an unconfined state in a small diameter cartridge, even at low temperature, and a method of producing the same.

(2) Description of the Prior Art

There have hitherto been known two kinds of explosives containing nitroparaffin. The one does not contain water and the other contains water. The use of water has the following merits. The inorganic oxidized acid salt is dissolved in water to form a relatively homogeneous explosive, and the explosive is highly reactive at the detonation point and has a high detonation velocity. However, the use of water has the following demerits. Water has a heat reducing effect, and further tends to separate from nitroparaffin.

Nitroparaffin series explosives containing no water are disclosed in various patents, for example, in U.S. Pat. Nos. 3,338,165, 3,377,217, 3,762,970 and the like. Some of the nitroparaffin series explosives containing no water are initiated by a blasting cap and some of them are not initiated by a blasting cap. Nitroparaffin series explosives containing water are disclosed in U.S. Pat. Nos. 3,419,444, 3,765,966 and the like. In general, nitroparaffin series explosives containing water are fewer in the number of explosives having cap sensitivity than nitroparaffin series explosives containing no water. Nitroparaffin series explosives having cap sensitivity are disclosed in U.S. Pat. Nos. 3,765,966, 3,985,593 and the like. The explosive disclosed in U.S. Pat. No. 3,985,593 contains perchlorate or a mixture thereof with inorganic oxidized acid salt, and is inferior in performance (e.g., initiation sensitivity in an unconfined state, and force of explosive) and in the price compared to the explosive of the present invention containing ammonium nitrate or a mixture thereof with other inorganic oxidized acid salt. The explosive disclosed in U.S. Pat. No. 3,765,966 is somewhat similar to that of the present invention in the composition. However, even when the nitromethane content is increased in the explosive of U.S. Pat. No. 3,765,966, the explosive is not initiated by a No. 6 detonator in an unconfined state in a small diameter cartridge at low temperature; also the explosive does not contain amide and perchlorate. The inventors have solved the above described drawbacks of prior explosives.

SUMMARY OF THE INVENTION

An object of the present invention is to provide a nitroparaffin series water-gel explosive which can be initiated by the No. 6 detonator, even at low temperature in an unconfined state in a small diameter cartridge, even in the case of low nitroparaffin content.

Another object of the present invention is to provide a method of producing the above described explosive.

A feature of the present invention is the provision of a water-gel explosive comprising (a) ammonium nitrate alone or in admixture with other inorganic oxidized acid salt, (b) water, (c) nitroparaffin having 1 to 3 carbon atoms, (d) a gelatinizing agent for water, (e) a gelatinizing agent for nitroparaffin, (f) glass hollow microspheres and (g) an amide.

Another feature of the present invention is the provision of a method of producing the water-gel explosive, which comprises mixing a mixture composed of nitroparaffin and glass hollow microspheres with a mixture composed of a gelatinizing agent for nitroparaffin and amide, mixing the resulting mixture together with a solution or dispersion of ammonium nitrate or a mixture thereof with other inorganic oxidized acid salt, and further mixing the resulting mixture together with a gelatinizing agent for water.

BRIEF DESCRIPTION OF THE DRAWINGS

In FIGS. 1 and 2, respectively the component shown by the mark "*", i.e., the amide, was not used in Comparative Example 1, and the component shown by the mark "**" is one which is replaced by ethylene glycol in Comparative Examples 2 and 3.

DETAILED DESCRIPTION OF THE PREFERRED EMBODIMENTS

The present invention will be explained in more detail. That is, the water-gel explosive of the present invention is composed of the following components.

Ammonium nitrate or a mixture of ammonium nitrate with other inorganic oxidized acid salt (for example, sodium nitrate, sodium perchlorate and the like) is used in an amount of 50 to 75% (hereinafter, "%" means % by weight based on the total amount of the explosive. Water is used in an amount of 5 to 20%, preferably 10 to 15%. Nitroparaffin, such as nitromethane, nitroethane, nitropropane or the like, is used in an amount of 5 to 40%. Among the nitroparaffins, nitromethane is preferably used in an amount of 7 to 20%. As the amide, use is made of formamide, acetamide, N,N-dimethylformamide and the like. These amides are used in an amount of 2 to 10%. Among them, formamide is preferably used in an amount of 3 to 7%. Glass hollow microspheres are used in an amount of 1 to 6%, preferably 2 to 4%. The gelatinizing agent for nitroparaffin includes nitrocellulose, ethylcellulose, cellulose acetate and the like, and is used in an amount of 0.5 to 5%. As the gelatinizing agent for water, use is made of self-crosslinking type gum (for example, guar gum containing potassium pyroantimonate), and a mixture of a gum, such as guar gum, xanthan gum or the like, starch and a crosslinking agent for gum, such as sodium dichromate, ammonium borate or the like.

Figure 1:
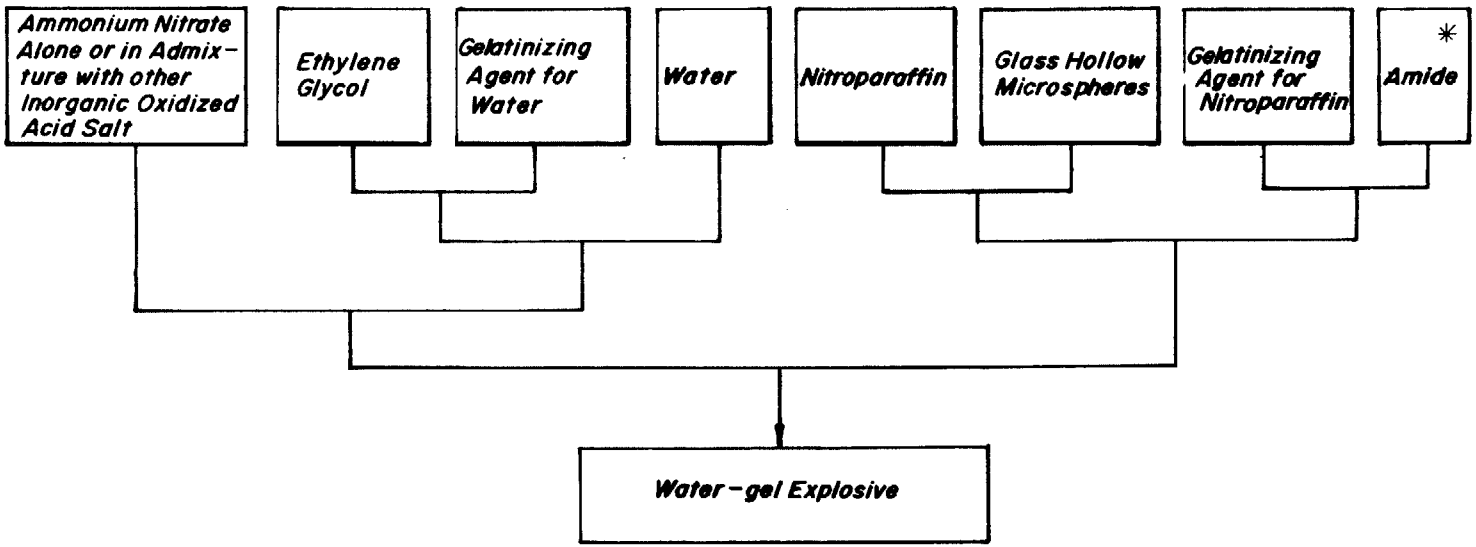
FIG. 1 is a block diagram for explaining the production steps in a method of producing the explosive of the present invention in the case where a conventional method is applied to the production of the explosive (this method is called as Method A)

The method of producing the water-gel explosive of the present invention will be explained hereinafter. A conventional method applied for the production of the explosive of the present invention will be called as Method A hereinafter (refer to FIG. 1), and the newly proposed method for the production of the explosive of the present invention will be called as Method B hereinafter (refer to FIG. 2).

Method A is as follows. A gelatinizing agent for water is dispersed in ethylene glycol, and then water is added to the dispersion to gel the water. The gelatinized water is mixed with ammonium nitrate or a mixture of ammonium nitrate with other inorganic oxidized acid salt (hereinafter, ammonium nitrate or a mixture thereof with other inorganic oxidized acid salt is merely called as "inorganic oxidized acid salt, such as ammonium nitrate") to form a mixture of gelatinized water with inorganic oxidized acid salt, such as ammonium nitrate. Meanwhile, a mixture composed of a gelatinizing agent for nitroparaffin and amide is mixed with a mixture composed of glass hollow microspheres and nitroparaffin, to obtain gelatinized nitroparaffin containing the glass hollow microspheres. The resulting gelatinized nitroparaffin is mixed with the above obtained mixture composed of gelatinized water and inorganic oxidized acid salt, such as ammonium nitrate, to produce a water-gel explosive.

This Method A is not suitable for the continuous production of explosive, but is suitable for the batch-system production of explosive, because the gelatinized water and the mixture of gelatinized water with inorganic oxidized acid salt, such as ammonium nitrate, have a high viscosity. Therefore a long time is required in the production of a homogeneous mixture of the gelatinized water with the inorganic oxidized acid salt, such as ammonium nitrate, and in the production of a homogeneous mixture of the above obtained mixture with the gelatinized nitroparaffin (more than 1 minute is required in the mixing).

Method B is as follows. An aqueous solution or suspension of the inorganic oxidized acid salt, such as ammonium nitrate, is produced. A dispersion of a gelatinizing agent for nitroparaffin in an amide is added to a mixture of glass hollow microspheres with nitroparaffin to gelatinize the nitroparaffin. Then, the resulting mixture is mixed with the above obtained suspension of inorganic oxidized acid salt, such as ammonium nitrate, and then with a gelatinizing agent for water to obtain the water-gel explosive of the present invention. The term "suspension" herein used means a mixture of a liquid and a solid suspended in the liquid.

In Method B, the water is gelatinized in the final step. The mixture or inorganic oxidized acid salt, such as ammonium nitrate, with water is a fluid suspension. Further, when the mixture of nitroparaffin with glass hollow microspheres is mixed with the mixture of an amide with a gelatinizing agent for nitroparaffin, the four components are fully mixed to form a first homogeneous fluid mixture without causing gelatinization. Therefore, this first fluid mixture is homogeneously mixed with the suspension of inorganic oxidized acid salt, such as ammonium nitrate, to form a second fluid mixture, and the second fluid mixture is mixed with a gelatinizing agent for water while maintaining its fluidity. In this final the mixing of components is carried out, but gelatinization does not proceed too rapidly, and the fluidity of the resulting mixture is maintained. In Method A, gelatinization of water proceeds in a relatively early stage of mixing, and the gelatinization is apt to occur due to the presence of small amounts of substances other than water. On the contrary, in Method B, the gelatinization proceeds in the later stage of mixing and the gelatinization proceeds further even after the resulting mixture has been packed to form an explosive of the final product.

Further, in Method A, ethylene glycol is used in order to improve the dispersibility of the gelatinizing agent for water, such as gum or the like, in water. On the contrary, in Method B, the gelatinizing agent for water, such as gum or the like, is finally added to the suspension of inorganic oxidized acid salt, such as ammonium nitrate, and therefore the gelatinizing agent for water disperses homogeneously in the suspension even in the absence of ethylene glycol, due to the friction of particles.

As described above, in the production method according to the present invention, all of the mixtures formed in the intermediate steps and in the final step are fluid mixtures, and therefore the mixing of components can be easily carried out in a short period of time (less than 1 minute is required in the mixing). Therefore, the method of the present invention is suitable for the continuous production of explosive and has a favorable influence upon the explosive performance of the resulting explosive.

The following examples are given for the purpose of illustration of this invention and are not intended as limitations thereof.

EXAMPLES AND COMPARATIVE EXAMPLES

Water-gel explosives having a compounding recipe shown in the following Table 1 were produced by the Method A or B through the mixing time shown in Table 1. The results of performance tests of the explosives are shown in Table 1.

The test method is as follows. In the initiation test, 200 g of a sample explosive was charged in a tube of polyethylene film of 25 mm diameter, and adjusted to a given temperature. Then, the tube was placed on sand and initiation of the explosive was attempted in an unconfined state by the use of the No. 6 detonator, and it was observed whether or not the explosive had been initiated. At the same time, the detonation velocity was measured by the ion gap method.

Table 1(a)

| Comparative Example No.* | Comparative Example | | | | Example | | | | | | | |
|---|---|---|---|---|---|---|---|---|---|---|---|---|
| and Example No.* | 1 | 2 | 3 | 4 | 1 | 2 | 3 | 4 | 5 | 6 | 7 | 8 |
| Compounding recipe (wt. %) | | | | | | | | | | | | |
| Ammonium nitrate | 61.2 | 59.2 | 47.3 | 49.3 | 56.3 | 57.5 | 57.5 | 48.8 | 51.9 | 57.8 | 35.5 | 45.3 |
| Sodium nitrate | — | — | 11.8 | 12.7 | 12.9 | — | — | 12.2 | 13.0 | 14.4 | 23.7 | 10.4 |
| Sodium perchlorate | — | — | — | — | 2.6 | — | — | — | 3.2 | 3.6 | — | 3.2 |
| Water | 15.3 | 14.8 | 14.8 | 14.8 | 7.2 | 12.5 | 12.5 | 12.2 | 13.0 | 8.3 | 11.8 | 14.8 |
| Nitroparaffin | | | | | | | | | | | | |
| Nitromethane | 18.3 | 17.8 | 17.8 | 17.8 | 11.2 | 19.2 | 19.2 | 15.2 | 9.7 | 7.2 | 17.8 | 14.0 |
| Nitroethane | — | — | — | — | — | — | — | — | — | — | — | 1.9 |
| Nitropropane | — | — | — | — | — | — | — | — | — | — | — | 1.9 |
| Glass hollow microspheres | 3.1 | 3.0 | 3.0 | — | 3.6 | 2.9 | 2.9 | 3.0 | 3.2 | 3.6 | 3.0 | 3.0 |
| Dimethylalkyl(coco)betaine Amide | — | — | — | 0.1 | — | — | — | — | — | — | — | — |

Table 1(a)-continued

| Comparative Example No.* and Example No.* | Comparative Example 1 | 2 | 3 | 4 | Example 1 | 2 | 3 | 4 | 5 | 6 | 7 | 8 |
|---|---|---|---|---|---|---|---|---|---|---|---|---|
| Formamide | — | — | — | 3.0 | 3.6 | 5.7 | — | 5.9 | 3.2 | 3.6 | 5.9 | 3.2 |
| Acetamide | — | — | — | — | — | — | 5.7 | — | — | — | — | — |
| Nitrocellulose | 0.6 | 0.6 | 0.6 | 0.6 | 0.7 | 0.6 | 0.6 | 0.7 | 0.7 | 0.7 | 0.6 | 0.6 |
| Ethylene glycol | 0.9 | 3.0 | 3.0 | — | 1.1 | — | — | — | — | — | — | — |
| Gelatinizing agent for water** | 0.6 | 1.6 | 1.7 | 1.7 | 0.8 | 1.6 | 1.6 | 2.0 | 2.1 | 0.8 | 1.7 | 1.7 |
| Production method | A | B | B | B | A | B | B | B | B | B | B | B |
| Mixing time (sec.) | 113 | 16 | 18 | 15 | 105 | 15 | 16 | 18 | 17 | 20 | 14 | 15 |

Table 1(b)

| Comparative Example No.* and Example No.* | Comparative Example 1 | 2 | 3 | 4 | Example 1 | 2 | 3 | 4 | 5 | 6 | 7 | 8 |
|---|---|---|---|---|---|---|---|---|---|---|---|---|
| Continuous production*** | x | o | o | o | x | o | o | o | o | o | o | o |
| Results of performance tests | | | | | | | | | | | | |
| Initiation test**** | | | | | | | | | | | | |
| Initiation at + 20° C. | o | x | x | x | o | o | o | o | o | o | o | o |
| Initiation at low temperature | | | | | | | | | | | | |
| Temperature | + 5° C. | + 5° C. | + 5° C. | + 5° C. | − 5° C. | 0° C. | 0° C. | − 10° C. | − 5° C. | 0° C. | − 5° C. | − 5° C. |
| Initiation | x | x | x | x | o | o | o | o | o | o | o | o |
| Detonation velocity (m/sec) | | | | | | | | | | | | |
| Velocity at + 20° C. | 3,620 | — | — | — | 3,270 | 4,160 | 4,010 | 3,580 | 2,950 | 2,880 | 2,120 | 3,280 |
| Velocity at low temperature | | | | | | | | | | | | |
| Temperature | | | | | − 5° C. | 0° C. | 0° C. | − 10° C. | − 5° C. | 0° C. | − 5° C. | − 5° C. |
| Velocity | — | — | — | — | 3,080 | 3,930 | 3,830 | 3,130 | 2,780 | 2,790 | 1,960 | 3,040 |

Note:
*The explosives obtained in the Comparative examples and Examples had a package density within the range of 1.15–1.25.
**Guar gum containing potassium pyroantimonate.
***In the item of continuous production, the mark "o" shows that continuous production is possible and the mark "x" shows that continuous production is impossible.
****In the item of initiation test, the mark "o" shows that the explosive is initiated, and the mark "x" shows that the explosive is not initiated.

The compounding recipe, the production method and the result of performance tests in the Comparative Examples and Examples will be explained hereinafter.

The explosive of Comparative Example 1 was produced according to Method A, and the explosives of Comparative Examples 2, 3 and 4 were produced according to Method B. In Comparative Example 4, a surfactant, dimethylalkyl(coco)betaine, was used in place of glass hollow microspheres to produce an explosive containing foams. The explosive of Comparative Example 4 was not detonated at either room temperature or low temperature.

Figure 2:
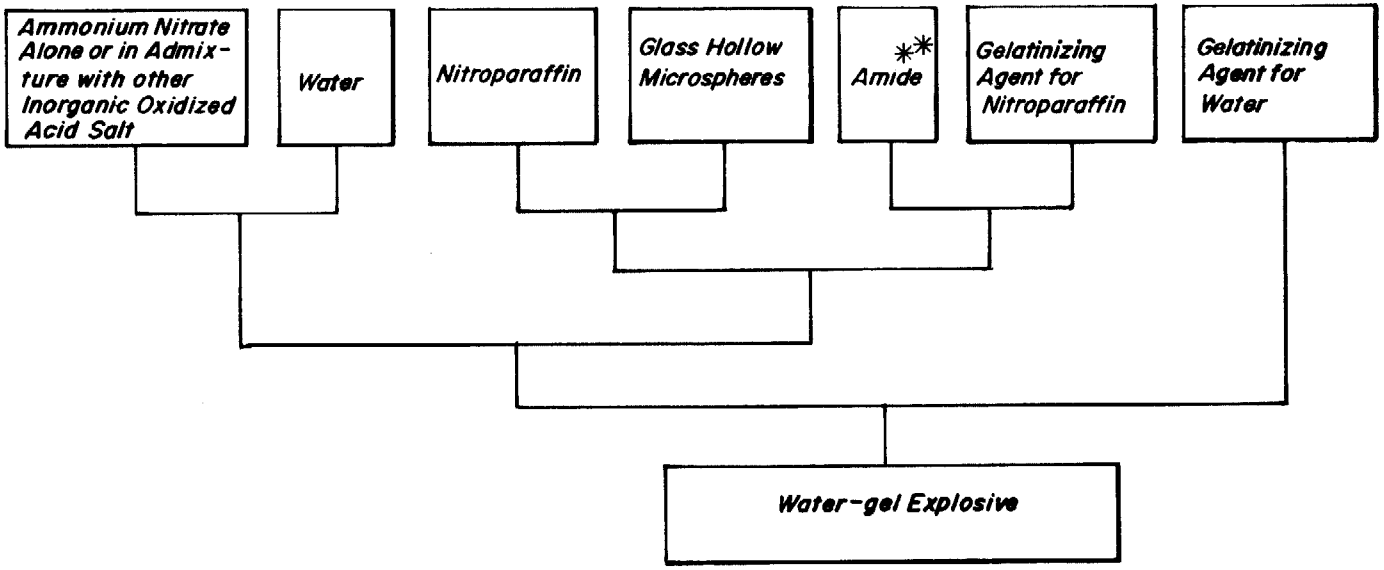
FIG. 2 is a block diagram for explaining the production steps of the newly proposed method of producing the explosive of the present invention (this method is called as Method B).

In Comparative Example 1, an amide (the component shown by the mark * in FIG. 1) was not used, and in Comparative Examples 2 and 3, ethylene glycol was used in place of an amide (the component shown by the mark ** in FIG. 2). However, Comparative Example 1 was carried out according to Method A, and Comparative Examples 2, 3 and 4 were carried out according to Method B. Therefore, the method of Comparative Example 1 was described as Method A, and the method of Comparative Examples 2, 3 and 4 were described as Method B in the above Table 1.

In Example 1, a water-gel explosive of the present invention was produced according to Method A. The explosive of Example 1 is remarkably superior in the initiation sensitivity to the explosives of Comparative Examples 1, 2 and 3 in spite of the low content of nitromethane. In Example 2, a water-gel explosive of the present invention was produced by Method B, that is, by the method of the present invention. The explosive of Example 2 is superior to the explosive of Comparative Example 1 in the detonation velocity, initiation sensitivity at low temperature and adaptability to continuous production. The explosives of Examples 2, 3 and 4 correspond to the explosives of Comparative Examples 2 and 3 except containing an amide in place of ethylene glycol, and are remarkably superior in the initiation sensitivity of the explosives of Comparative Examples 2 and 3. This shows that amide is effective. Example 3, wherein acetamide is used in place of formamide used in Example 2, shows that acetamide has the same effect as formamide. The explosive of Example 4 contains sodium nitrate and is remarkably superior in low-temperature initiation sensitivity compared to the explosives of Comparative Example 3 and Examples 2 and 3. The explosives of Examples 5 and 6 further contain sodium perchlorate as an inorganic oxidized acid salt, and have the same low-temperature initiation sensitivity as that of Examples 1 to 4, even though using a smaller amount of nitromethane than the amount used in Examples 1 to 4. Example 7 shows that a water-gel explosive having a low detonation velocity and a high low-temperature initiation sensitivity can be obtained by the use of a large amount of sodium nitrate. Example 8 shows that a water-gel explosive containing a mixture of nitromethane, nitroethane and nitropropane as nitroparaffin has the same low-temperature initiation sensitivity as that of explosives of Examples 1 to 7 containing nitromethane.

Further, it can be seen from Table 1 that, although the method according to the present invention (Method B) is short in the mixing time, the resulting explosive has a sufficiently high initiation sensitivity.

What is claimed is:

1. A water-gel explosive comprising (a) ammonium nitrate alone or in admixture with other inorganic oxidized acid salt, (b) water, (c) nitroparaffin having 1 to 3 carbon atoms, (d) a gelatinizing agent for water, (e) a gelatinizing agent for nitroparaffin, (f) glass hollow microspheres and (g) an amide.

2. A water-gel explosive according to claim 1, wherein said other inorganic oxidized acid salt is sodium nitrate.

3. A water-gel explosive according to claim 1, wherein said other inorganic oxidized acid salt is composed of sodium nitrate and sodium perchlorate.

4. A water-gel explosive according to claim 1, wherein said nitroparaffin is nitromethane.

5. A water-gel explosive according to claim 1, wherein said amide is formamide.

6. Method of producing water-gel explosives, which comprises mixing a mixture composed of nitroparaffin and glass hollow microspheres with a mixture composed of a gelatinizing agent for nitroparaffin and an amide, mixing the resulting mixture together with a solution or suspension of ammonium nitrate or a mixture thereof with other inorganic oxidized acid salt, and further mixing the resulting mixture together with a gelatinizing agent for water.

7. A water-gel explosive according to claim 2 wherein said nitroparaffin is nitromethane.

8. A water-gel explosive according to claim 3 wherein said nitroparaffin is nitromethane.

9. A water-gel explosive according to claim 2 wherein said amide is formamide.

10. A water-gel explosive according to claim 3 wherein said amide is formamide.

11. A water-gel explosive according to claim 4 wherein said amide is formamide.

12. A water-gel explosive according to claim 1 wherein the ammonium nitrate or admixture thereof with other oxidized acid salt is used in an amount of from 50% to 75% by weight, based on the total amount of the explosive.

13. A water-gel explosive according to claim 1 wherein the water is used in an amount of from 5% to 20% by weight, based on the total amount of the explosive.

14. A water-gel explosive according to claim 13 wherein the water is used in an amount of from 10% to 15% by weight, based on the total amount of the explosive.

15. A water-gel explosive according to claim 1 wherein the nitroparaffin is used in an amount of from 5% to 40% by weight, based on the total amount of the explosive.

16. A water-gel explosive according to claim 4 wherein the nitromethane is used in an amount of from 7% to 20% by weight, based on the total amount of explosive.

17. A water-gel explosive according to claim 1 wherein the gelatinizing agent for nitroparaffin is used in an amount of from 0.5% to 5% by weight, based on the total amount of the explosive.

18. A water-gel explosive according to claim 1 wherein the glass hollow microspheres are used in an amount of from 1% to 6% by weight, based on the total amount of the explosive.

19. A water-gel explosive according to claim 18 wherein the glass hollow microspheres are used in an amount of from 2% to 4% by weight, based on the total amount of the explosive.

20. A water-gel explosive according to claim 1 wherein the amide is used in an amount of from 2% to 10% by weight, based on the total amount of the explosive.

21. A water-gel explosive according to claim 5, wherein the formamide is used in an amount of from 3% to 7% by weight, based on the total amount of the explosive.

* * * * *